US008740733B2

(12) United States Patent
Reese et al.

(10) Patent No.: US 8,740,733 B2
(45) Date of Patent: Jun. 3, 2014

(54) RACQUET PUTTER APPARATUS

(71) Applicants: Dennis F. Reese, Medina, OH (US); Mitchell V. Holden, Strongsville, OH (US)

(72) Inventors: Dennis F. Reese, Medina, OH (US); Mitchell V. Holden, Strongsville, OH (US)

( * ) Notice: Subject to any disclaimer, the term of this patent is extended or adjusted under 35 U.S.C. 154(b) by 5 days.

(21) Appl. No.: 13/671,741

(22) Filed: Nov. 8, 2012

(65) Prior Publication Data

US 2013/0123050 A1 May 16, 2013

Related U.S. Application Data

(60) Provisional application No. 61/558,708, filed on Nov. 11, 2011.

(51) Int. Cl.
*A63B 49/00* (2006.01)
*A63B 69/36* (2006.01)

(52) U.S. Cl.
USPC ..... 473/553; 473/257

(58) Field of Classification Search
USPC ..... 473/219, 226, 286, 257, 340, 517, 539, 473/553, 548, 557
See application file for complete search history.

(56) References Cited

U.S. PATENT DOCUMENTS

| | | | | | |
|---|---|---|---|---|---|
| 1,184,822 | A * | 5/1916 | Caplette, Jr. | ..... | 473/515 |
| 1,671,749 | A * | 5/1928 | Spaulding | ..... | 473/515 |
| 1,964,232 | A * | 6/1934 | Tromblee | ..... | 473/515 |
| 2,670,958 | A | 3/1954 | Leiser et al. | | |
| 4,213,608 | A | 7/1980 | Krishnan | | |
| 4,236,271 | A * | 12/1980 | Martino | ..... | 15/246 |
| 4,348,025 | A | 9/1982 | Wills et al. | | |
| 4,368,890 | A * | 1/1983 | Horstman et al. | ..... | 473/515 |
| 4,643,857 | A | 2/1987 | Cousin et al. | | |
| 5,083,777 | A * | 1/1992 | Held | ..... | 473/437 |
| D344,116 | S * | 2/1994 | Chen et al. | ..... | D21/735 |
| 7,407,457 | B2 * | 8/2008 | Dollins | ..... | 473/548 |
| 8,277,341 | B1 * | 10/2012 | Vignola | ..... | 473/457 |
| 2007/0191154 | A1 | 8/2007 | Genereux et al. | | |
| 2009/0033034 | A1 | 2/2009 | Jakubowski | | |

* cited by examiner

*Primary Examiner* — Nini Legesse
(74) *Attorney, Agent, or Firm* — Christopher L. Parmelee; Walker & Jocke

(57) ABSTRACT

A projection in operative connection with a tip of a racquet is provided, such that at least a portion of the projection extends outwardly from a frame of the racquet. The frame has a shape of a loop and a plurality of transversely orientated sets of strings that span the loop and are connected to the frame. The projection includes a substantially flat surface orientated parallel to the at least one face of the strings. The projection is in rigid connection with the racquet and extends from the tip of the frame opposite a handle connected to the frame for a distance operative to serve as a putting surface for putting a ball along the ground.

13 Claims, 10 Drawing Sheets

RACQUET PUTTER APPARATUS

BACKGROUND

A golf course typically experiences a fluctuation in the number of golfers using the course, depending on the time of day, day of the week, and time of the year. Thus golf courses often have time periods during which the golf course is underutilized and generates less revenue relative to busier time periods.

In addition, the game of golf is a relatively expensive hobby, requiring expensive golf clubs and a large time commitment to become competent at playing the game. Such high monetary and time commitment costs limit the number of people willing to play golf. For example, unlike movie theatres that generate income from people of all ages and income brackets, many golf courses predominantly generate revenue from adults with middle class incomes or higher. Thus the reduced potential pool of available people willing to play golf reduces the potential income of golf courses.

Thus, golf courses may benefit from improvements.

SUMMARY

The following is a brief summary of subject matter that is described in greater detail herein. This summary is not intended to be limiting as to the scope of the claims.

In an example embodiment, an apparatus is provided that facilitates playing a game on a golf course (or other field) in a manner that is generally less expensive than playing golf and that requires less practice to become competent at the game. In an example, the apparatus may be comprised of a racquet having a frame in the shape of a loop with a hollow interior. The racquet may also include a plurality of transversely oriented sets of strings mounted to the frame so as to span the loop in a generally common plane. Opposed sides of the strings correspond to opposed faces that are usable to hit and propel a ball through the air (such as along a golf course fairway).

The example apparatus may also include a projection that extends outwardly from the tip of the frame. Such a projection may include a substantially flat surface usable to hit a ball along the ground (such as a golf course green). The flat surface may be orientated parallel to the faces of the strings. The position and size of the flat surface may be sufficient to enable the projection to move along the ground so that the flat surface contacts a middle portion of the ball resting on the ground, while preventing the ball from contacting the strings, or other surface on the racquet that could interface with the flat surface solely contacting the ball.

In an example embodiment, the ball may correspond to or have a size similar to a tennis ball, racquet ball, golf ball, or other ball with an outer diameter less than the minimum width of the frame of the racquet. Also, in this example, the racquet may correspond to or have a size similar to a tennis racquet, racquet ball racquet or other type of racquet.

In an example embodiment, the described projection may be included as part of an adapter that is configured to mount around at least a portion of the frame of the racquet to maintain the flat surface in generally rigid engagement with the racquet. However, in further example embodiments, the described projection may be an integral portion of the frame of the racquet.

This described apparatus may be used in place of a golf club and golf putter to play a game with rules similar to the rules of golf. For example, a user of the apparatus may initially drive a ball from a tee area of a golf course onto a fairway by hitting the ball with the strings of the racquet. The user may walk to and pick up a hit ball and again hit the ball with the strings of the racquet (for several times) until the ball lands/rolls onto a golf course putting green. Once the ball is on the putting green, the user may hit the ball with the flat surface of the projection on the end of the racquet in order to move the ball towards/into the hole in the putting green. The user may compile a score based on the number of strokes/hits on the ball needed to place the ball in the hole for a number of different holes (e.g., 3 holes, 9 holes, 18 holes) available at the golf course. Also, penalty strokes may be accessed to a score total for similar reasons associated with a traditional game of golf. Also, applicable golf etiquette rules may be followed.

Other aspects will be appreciated upon reading and understanding the attached figures and description.

DETAILED DESCRIPTION

Figure 1:
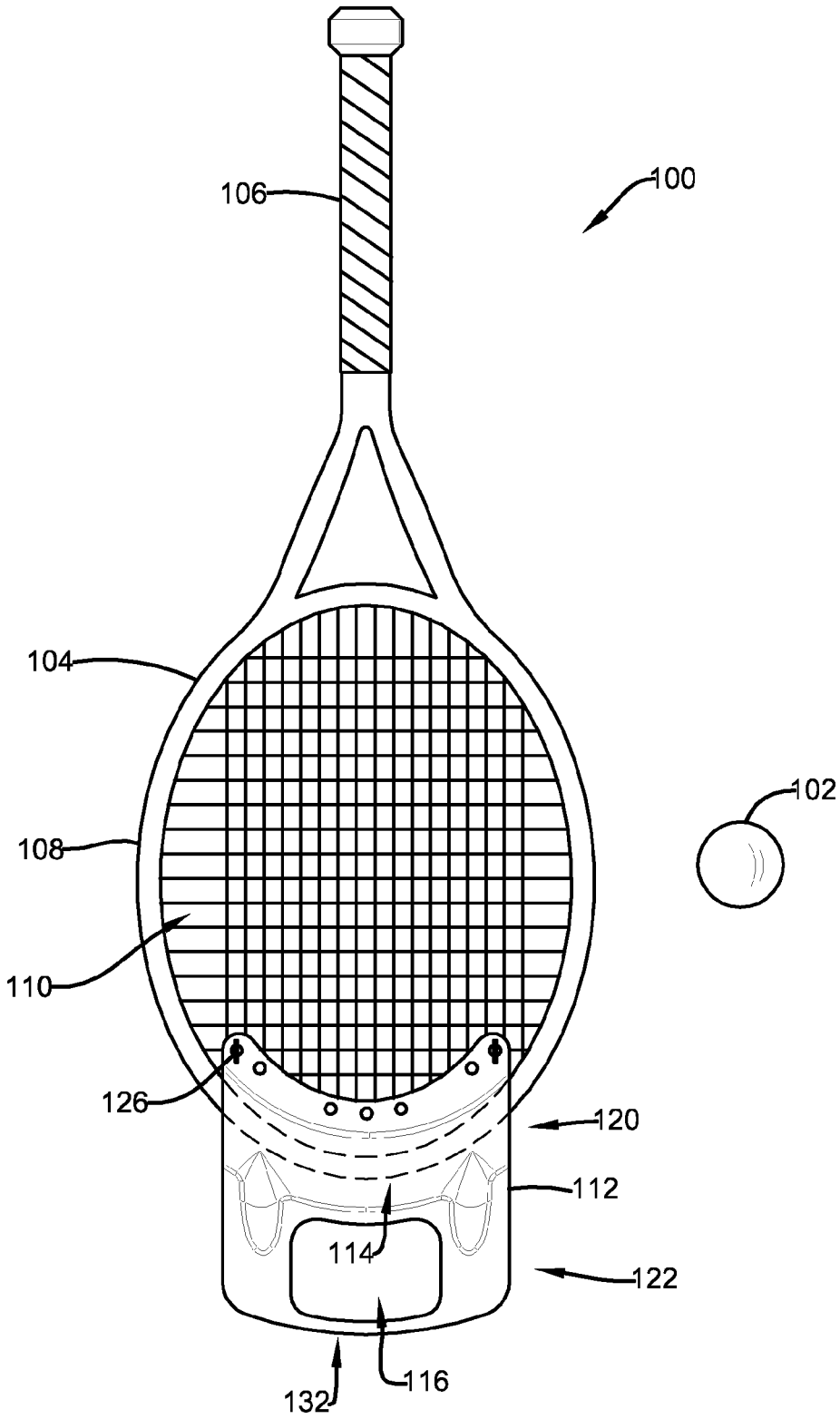
FIGS. 1-4 illustrate examples of apparatuses that are usable to play a game with a ball.

Various technologies pertaining to racquets usable to play a game with a ball will now be described with reference to the drawings, where like reference numerals represent like elements throughout. Also, it is to be understood that functionality that is described as being carried out by certain components may be performed by multiple components. Similarly, for instance, a component may be configured to perform functionality that is described as being carried out by multiple components.

With reference to FIG. 1, an example apparatus 100 that facilitates playing a game with a ball 102 is illustrated. The apparatus 100 includes a racquet 104 having a handle 106 (e.g., the grip of a tennis racquet) connected to a frame 108 (e.g., the head of a tennis racquet). The frame may be in the shape of a loop and includes a plurality of transversely orientated sets of strings 110 mounted to the frame in a pattern which spans the interior of the frame. In an example embodiment, the pattern of strings may correspond to two sets of interwoven and transversely oriented strings (extending respectively horizontally and vertically). However, it should be appreciated that in alternative embodiments, other patterns and orientations of strings may be used.

In example embodiments, the frame may be comprised of wood, aluminum, fiberglass, graphite, carbon fiber, titanium, ceramics and/or any other material that is operative to support a plurality of strings. Also, the strings may be comprised of a natural gut, nylon, polyester and/or any other flexible material.

In an example embodiment, the apparatus may include a projection 112 that extends outwardly from the tip 114 of the frame (e.g., head) of the racquet. The projection 112, may include a substantially flat surface 116 on at least one side of the projection, which flat surface is used to hit (i.e., putt) a ball along the ground.

As used herein and in the claims, the element/feature of a flat surface or a substantially flat surface are used interchangeably and both correspond to a either a uniformly planar and smooth surface or a substantially planar surface in which substantially all of the surface (e.g. 75% or more of the surface area of the flat surface/substantially flat surface) is substantially in a common plane (e.g., within 1 mm of the common plane). Thus, 75% or more of the surface area of the flat surface/substantially flat surface may be comprised of small bumps, textures and/or other raised and lowered areas relative the common plane, as long as such raised and lowered areas are substantially in the common plane. Also, it should be appreciated that other portions of the flat surface/substantially flat surface, other than the portions that are substantially in a common plane, may correspond to holes through the flat surface/substantially flat surface or other surface features that traverse the portions that are substantially in the common plane. Such other surface features (comprising 25% or less of the extent of the flat surface/substantially flat surface) may correspond to relatively deeper grooves, recesses, dips, scratches and/or other features which are located within and/or extend into the portions of the flat surface/substantially flat surface that are substantially in the common plane.

In the example shown in FIG. 1, the projection may be included as part of an adapter that is operative to removably mount to one or more models, styles and sizes of commercially sold and/or standards compliant: tennis racquets, squash racquets, racquetball racquets, badminton racquets, or any other type of racquet (having the previously described structures of a handle, frame and strings).

Figure 2:
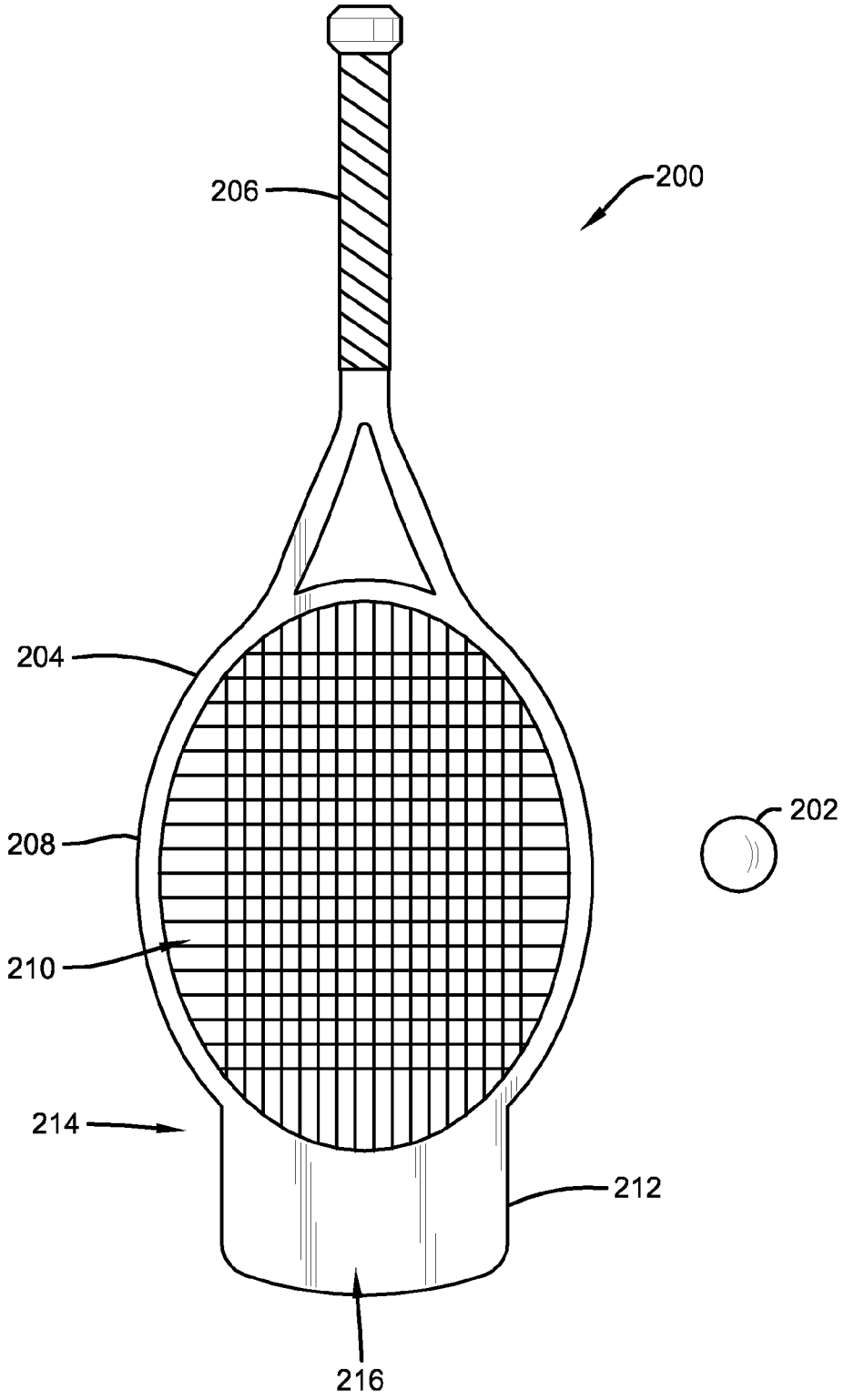

However, as shown in FIG. 2, in an alternative embodiment 200, the conventional design of a racquet (e.g., a tennis, racquetball, squash, badminton racquet) may be modified such that the tip 214 of the frame 208 of the racquet 204 includes an integral projection 212. Such an integral projection may be made of the same material (e.g., carbon composite, wood, fiberglass, aluminum) as the portion of the frame 208 (e.g., head) to which the strings 210 are mounted. However, in other embodiments, the projection may be made out of a different material that is fastened via an adhesive, bolts, screws, rivets, and or any other fastener directly to the tip of the frame of the racquet.

Figure 3:
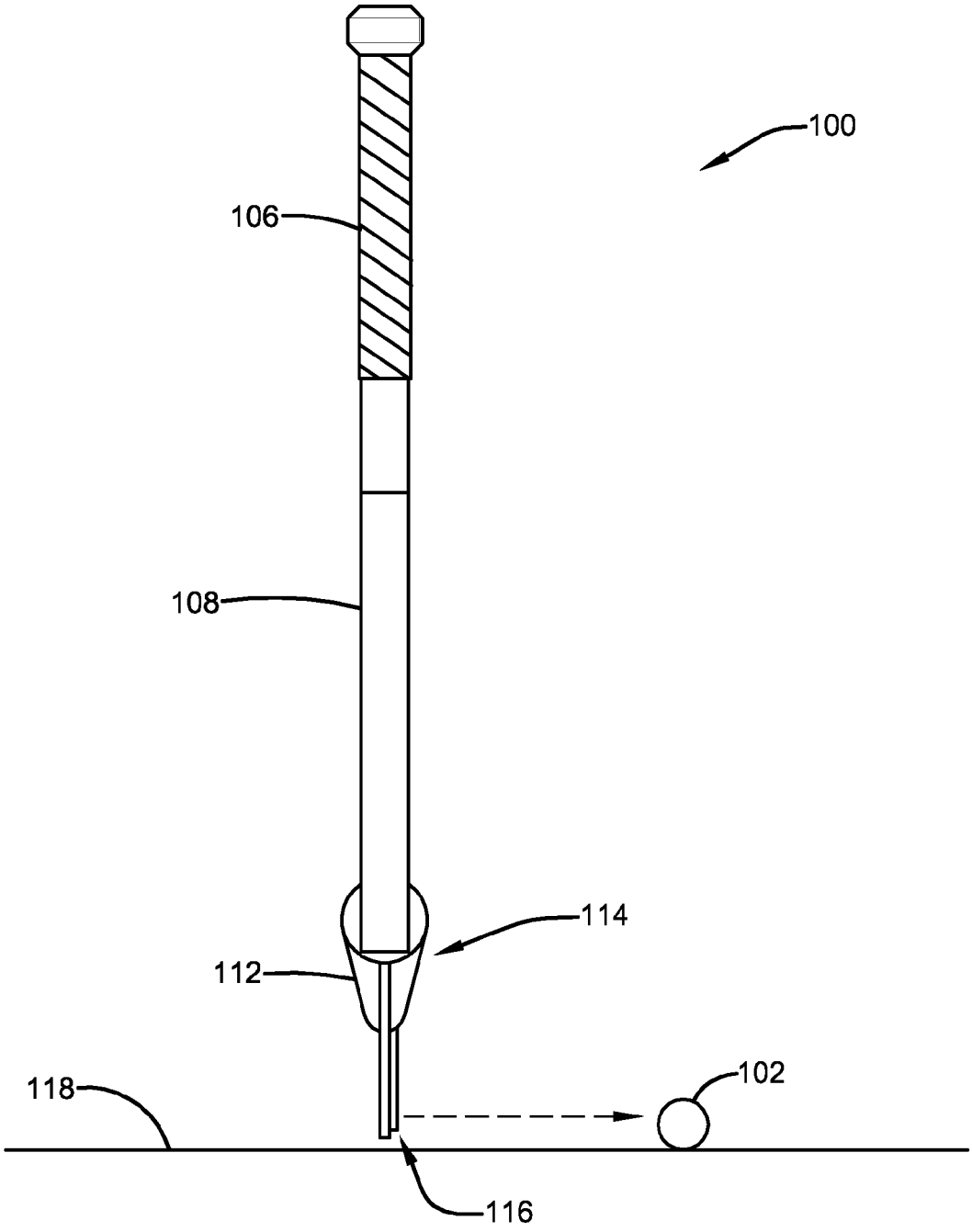
Figure 4:
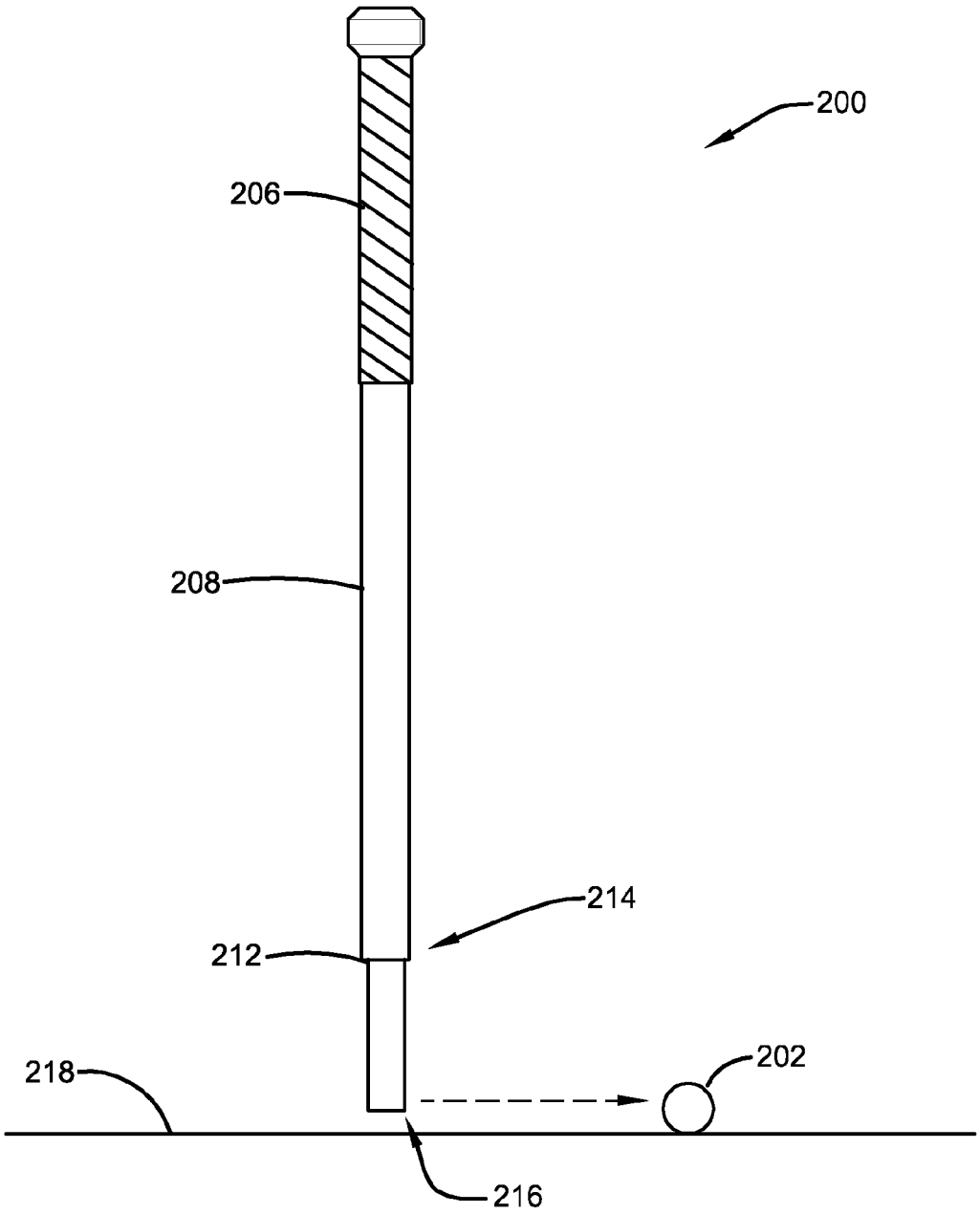

FIGS. 3 and 4 show examples of the described apparatuses 100, 200 orientated downwardly (with the handles 106, 206 on top) to putt a ball 102, 202 along the ground. In this example, the flat surfaces 116, 216 of the projections may have a sufficiently large surface area and may be positioned on the projections 112, 212 to enable a user holding the handle 106, 206 of the racquet to move the projection 112, 212 along the ground 118, 218 to contact the ball 102, 202 (resting on the ground) with the flat surface 116, 216 orientated in a generally vertically orientation.

In these examples, the flat surfaces 116, 216 may also extend sufficiently far from the strings/frame of the racquet to enable the flat surfaces 116, 216 to have a portion (in the vertical directions shown in FIGS. 1-4) that is operable to contact a middle portion of the ball (half way between the bottom and top portions of the ball when positioned on the ground) without the ball contacting other surfaces of the projection, adapter or frame. For example, the projection may extend from the tip of the frame opposite a handle connected to the frame for a distance of 1 to 5 inches (2.5 to 12.7 cm). Also, in an example, the flat surface may have a width and a length of at least 1 inch (2.5 cm). For example, in an embodiment the projection may extend from the tip of the frame opposite the handle (or other radial direction) for a distance of at least 2 inches (5.1 cm) and the flat surface may have a width and a length of at least 1.5 inches (3.8 cm).

However, it should be appreciated that alternative embodiments may have a surface area of the flat surface 116, 216 on the projections 112, 212 that have smaller or large sizes in one or more dimensions depending on the size of the ball and the amount of clearance from non-planar features on the racquet that are needed to hit the ball consistently with the flat surfaces.

Figure 5:
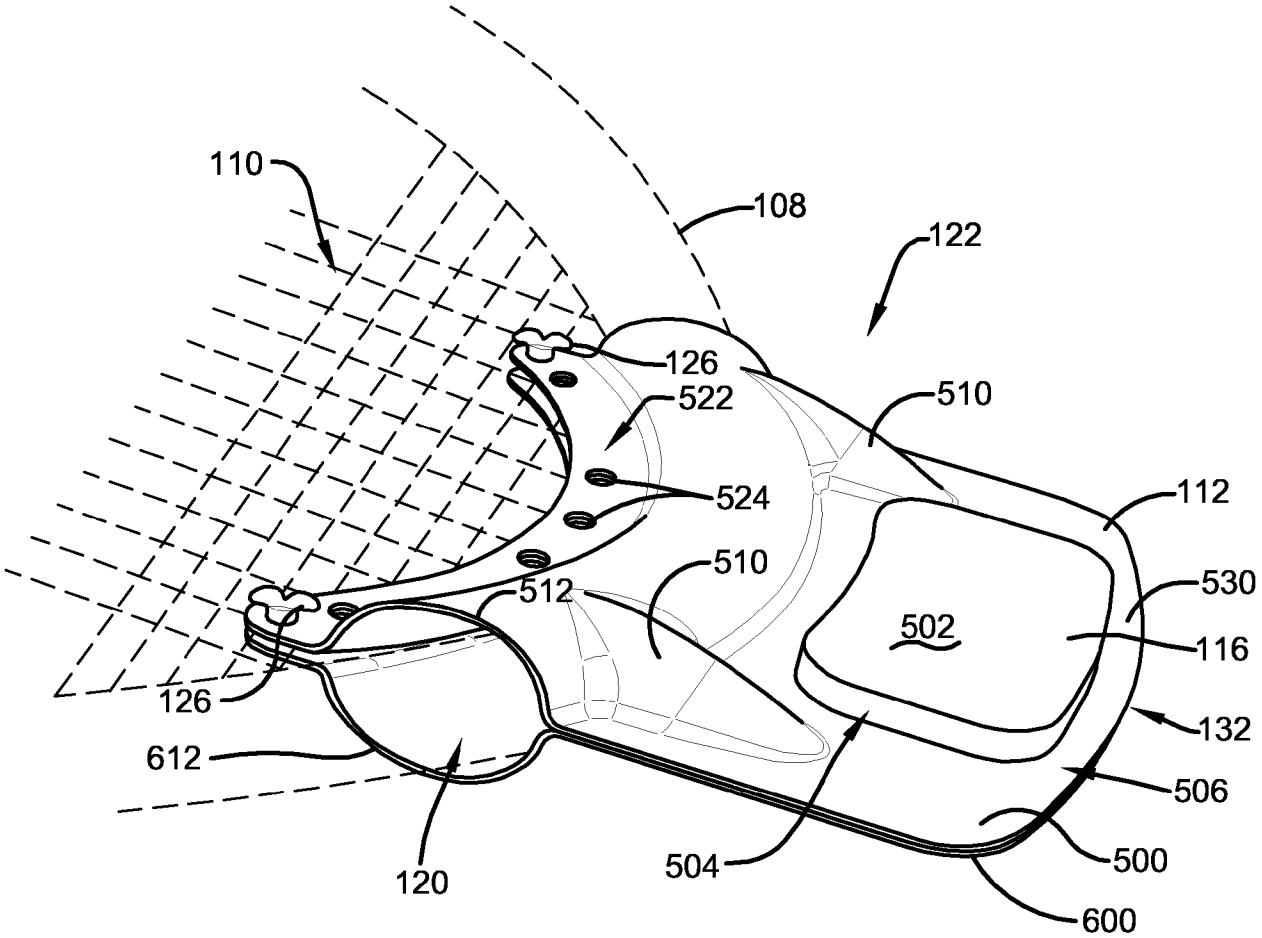
FIGS. 5-10 illustrate examples of an apparatus in the form of an adapter that is mounted to a racquet.
Figure 6:
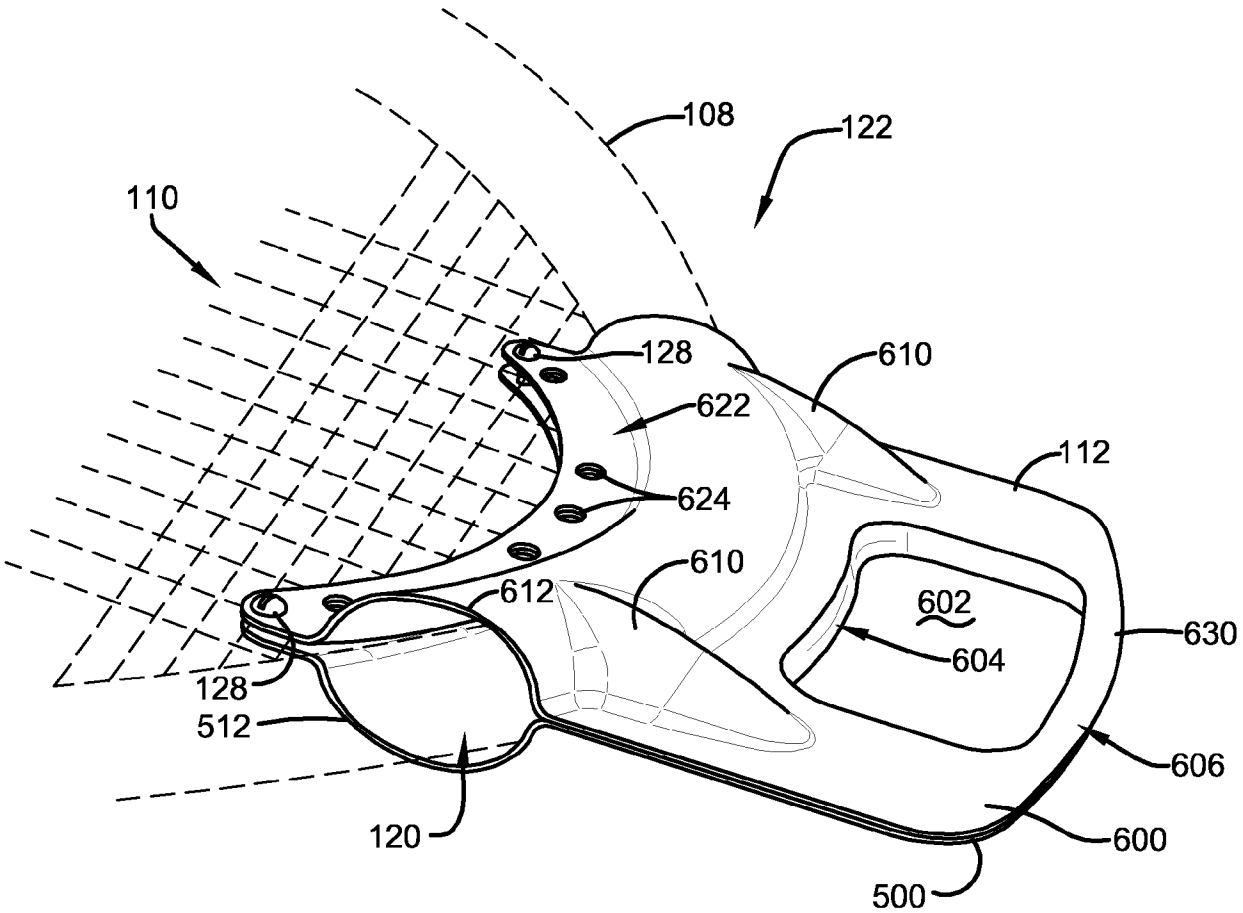

Referring back to FIG. 1, the embodiment of the projection 112 included as part of an adapter 122, may enable the projection 112 to be mounted in rigid connection with the racquet, such that the projection 112 may be used to putt a ball, without the projection bending or falling off of the racquet. FIGS. 5 and 6 show perspective views of opposite sides of the adapter 122 mounted to the tip of the frame 108 of a racquet (shown with phantom lines).

In these examples, the adapter 122 may be comprised of two interlocking plastic top 500 and bottom 600 members, that when engaged together, sandwich the frame 108 therebetween within a hollow channel 120. As shown in FIG. 5 (with the top member 500 facing upwardly), the top member 500 includes a raised portion 502 bounded by wall 504, which raised portion is elevated relative to edge portions 506 adjacent the periphery of the projection 112. In this example the raised portion 502 includes the flat surface 116 thereon.

In addition, the raised portion 502 facilitates mechanically fastening/coupling the top 500 member and bottom member 600 together. For example as shown in FIG. 6, the bottom member 600 (shown facing upwardly) includes a cavity 602 bounded by wall 604, which cavity extends downwardly relative edge portions 606 adjacent the periphery of the projection 112. This cavity 602 has a shape and size that is adapted to enable the walls 604 of the cavity to fit inside the elevated portion 502 of the top member 500 (shown in FIG. 5) to releasably connect the top and bottom members together.

Figure 7:
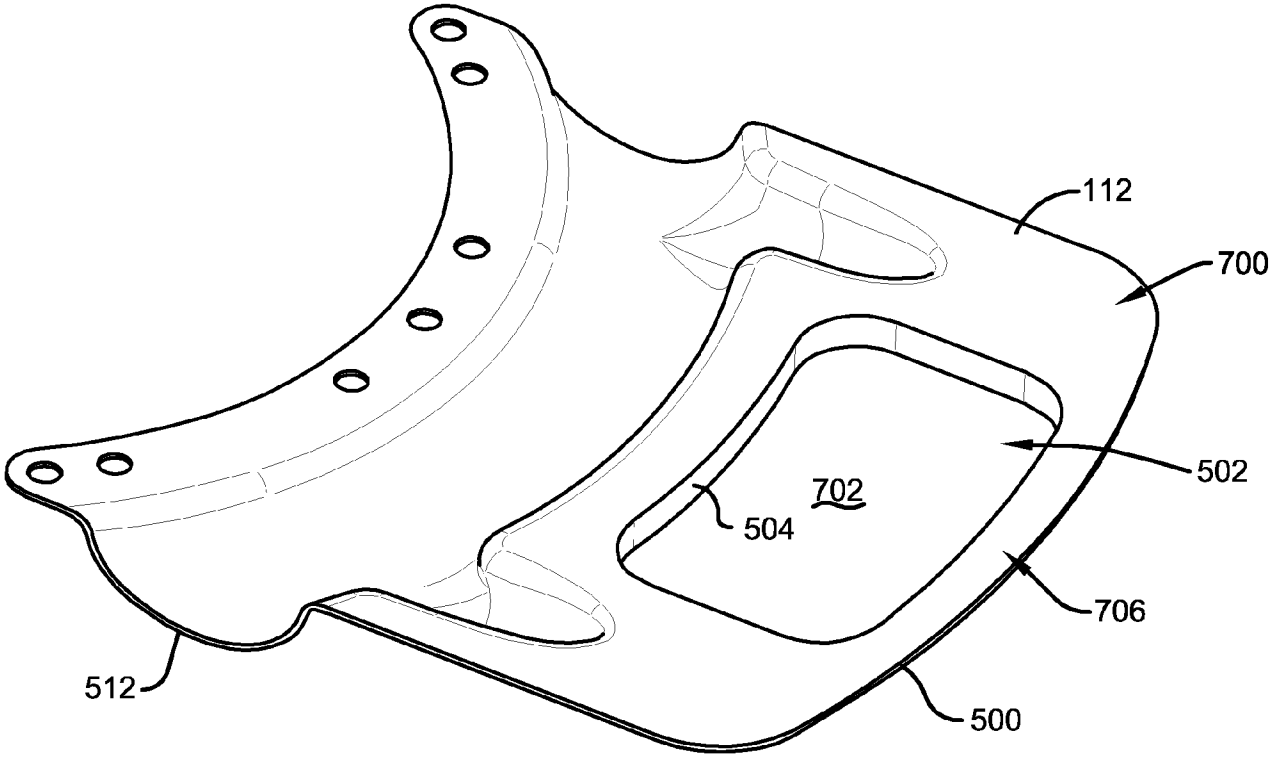

To illustrate this construction more clearly, FIG. 7 shows an inside face 700 of the top member 500. In this view, the inside of the elevated portion 502 is shown, which in this view has the form of a cavity 702 that extends downwardly relative to the edge portions 706 adjacent the periphery of the projection 112. The walls 504 that define the cavity 702 (in FIG. 7) correspond to the walls 504 that bound the elevated portion 502 (in FIG. 5).

Figure 8:
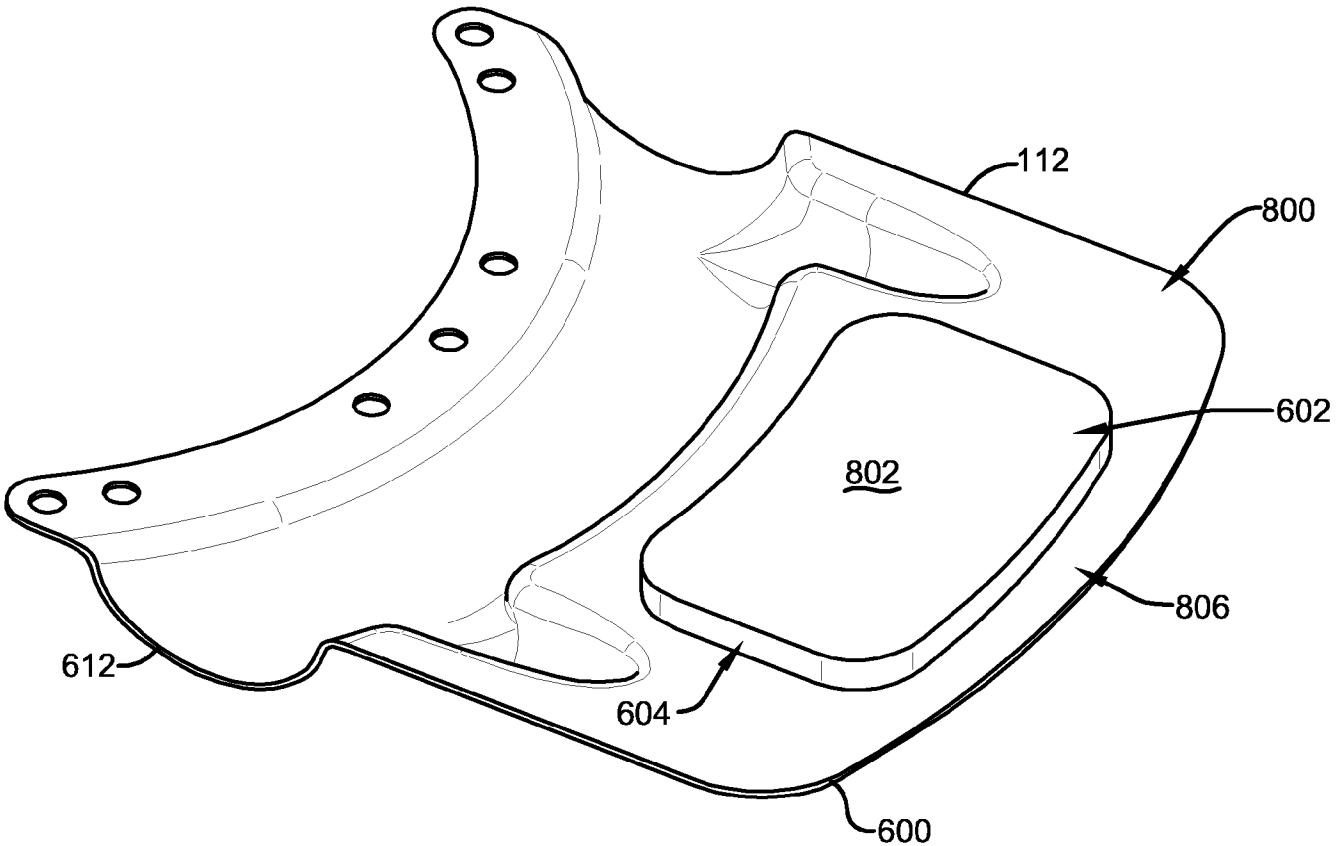

Also, to illustrate this construction more clearly, FIG. 8 shows an inside face 800 of the bottom member 600. In this view, the outside of the cavity 602 is shown, which in this view has the form of an elevated portion 802 that extends upwardly relative the edge portions 806 adjacent the periphery of the projection 112. The walls 604 that define the elevated portion 802 (in FIG. 8) correspond to the walls 604 that bound the inside of the cavity 602 (in FIG. 6) of the bottom member 600.

Figure 9:
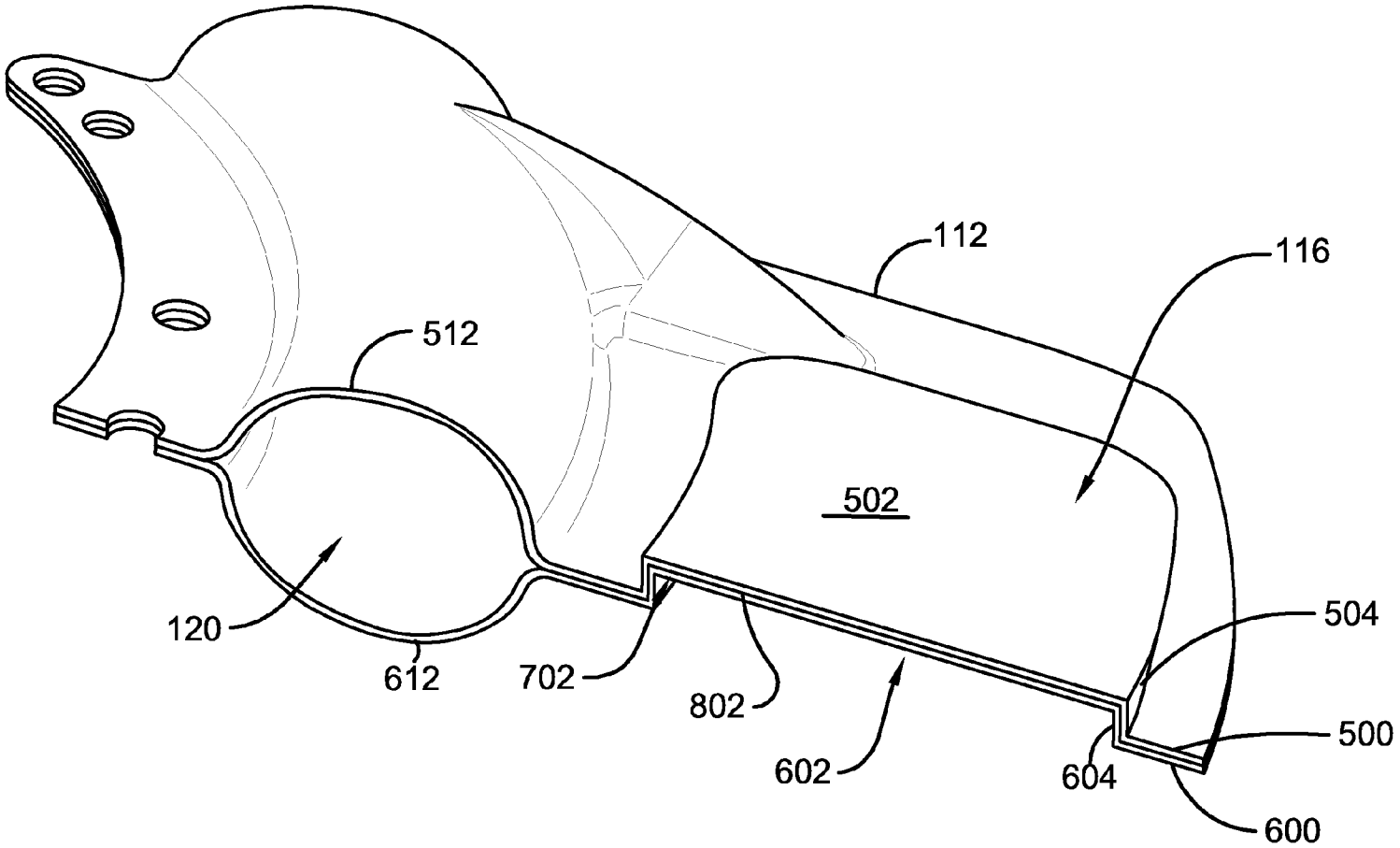

FIG. 9 shows a cross-section view of the projection 112 (with the top and bottom members connected together), which illustrates the elevated portion 802 of the lower member 600 extending into the cavity 702 on the inside of the elevated portion 502 of the top member 500. The relative sizes of the elevated portion 802 and cavity 702 may be such that the associated walls 504, 604 are compressed together sufficiently to hold the top and bottom members together.

In this example, the top and bottom members 500, 600 may be comprised of a hard plastic such as a polyethylene, polypropylene, PVC, or other type of plastic that is capable of putting a flexible ball (e.g., a racquet ball) hundreds or more times without the plastic cracking. It this example, to manufacture the projection, the top and bottom members may be vacuum formed from sheets of plastic or injection molded. Also, it should be appreciated that the adapter (and/or alternative shapes for the adapter) may be made out of other types of materials, including wood, aluminum, fiberglass, graphite, carbon fiber, titanium, ceramics and/or any other material that is operative to support a flat surface in rigid connection with the frame of a racquet.

To further enhance the rigidity of the projection 112, and prevent/minimize appreciable bending of the top and bottom members 500, 600 when a ball is putted, the top and bottom members may include further raised portions 510, 610 in the form of ribs or other reinforcing shapes. As shown in FIGS. 5 and 6 such raised portions may be positioned on opposed sides of the elevated portion 502 and cavity 602. Such raised portions 510, 610 may also extend outwardly from the walls 512, 612 in the top and bottom portions (that bound the channel 120) to further enhance the rigidity of the projection 112.

As shown in FIG. 1, the channel 120 may have a curvature that arcs in the same direction as the curvature of the tip 114 of the frame. However it should be appreciated that the curvature of the channel 120 may not be identical to the curvature of the tip of the frame. Rather the curvature and inner diameter of the channel 120 may have dimensions that are sufficiently large to receive therethrough a plurality of different styles, models, and curvatures of racquet frames.

Referring to FIGS. 5 and 6, to further secure the projection 112 to the racquet 104, the top and bottom members 500, 600 may include inner flanges 522, 622 adjacent to the channel 120, which flanges extend adjacent opposed faces of the strings, and which flanges sandwich the strings 110 of the racquet therebetween. In addition, the inner flanges 522, 622 may include a plurality of spaced apart holes 524, 624 therethrough (which are aligned on the top and bottom members 500, 600). Fasteners such as bolts 128, wing nuts 126, prongs, and/or other types of fasteners may be mounted all or some of the sets of holes 524, 624 to secure the flanges 522, 622 of the top and bottom members 500, 600 together.

It should be appreciated that fasteners such as bolts which extend through the holes 524, 624, also extend through the holes defined by the weave of the strings 110. However, it should also be appreciated that different models and styles of racquets may have strings with different spacing. Thus to accommodate different racquets (and string placement) the inner flanges 522, 622 may include six or more holes 524, 624 therethrough with different distances between at least some of the adjacent pairs of holes, in order to increase the odds that at least some of the holes will coincide with holes defined by the strings 110.

In addition, as shown in FIGS. 5 and 6, the projection 112 may include an outer flange 530, 630 adjacent the flat surface 116, such that the flat surface does not extend to an outer edge 132 of the racquet. However, it should be appreciated that in alternative embodiments, the flat surface 116 may extend to the outer edge 132. Also, although the flat surface 116 is shown on an elevated portion 502, it should be appreciated that in alternative embodiments the flat surface may not be elevated, relative an outer periphery of the projection 112. Rather the flat surface may extend to the outer edge 132.

As shown in FIGS. 5 and 6, the inner flanges traverse portions of the strings 110 of the racquet. However, it should be appreciated that in alternative embodiments, the adapter 122 may not include flanges (or walls of the channel 120) that traverse the strings. Rather, the adapter may include portions that only fasten to the frame of the racquet (e.g., clamps or other fasteners), to avoid decreasing the surface area of the strings 110 that is available to hit a ball.

In addition, as shown in FIGS. 2 and 3, the flat surface 116 may be parallel and/or coincident with at least one of the faces of the strings 110, and/or faces of the frame 108. However, it should be appreciated that in alternative embodiments, the flat surface 116 may be sloped, such as being orientated at an angle (e.g., between 1-45 degrees) with respect to the faces of the strings 110, and/or faces of the frame 108.

As shown in FIGS. 1 and 2, the projection with the flat surface may extend radially from the frame such as from the tip 114 of the frame in alignment with the longitudinal axis of the racquet (e.g. the axis that extends through the handle and the tip of the frame). However, it should be appreciated that the projection may be mounted to the racquet (or integrated into the frame of the racquet) such that the projection with the flat surface is not aligned with the longitudinal axis, but rather extends from either the right or left side (e.g., beam) of racquet.

Figure 10:
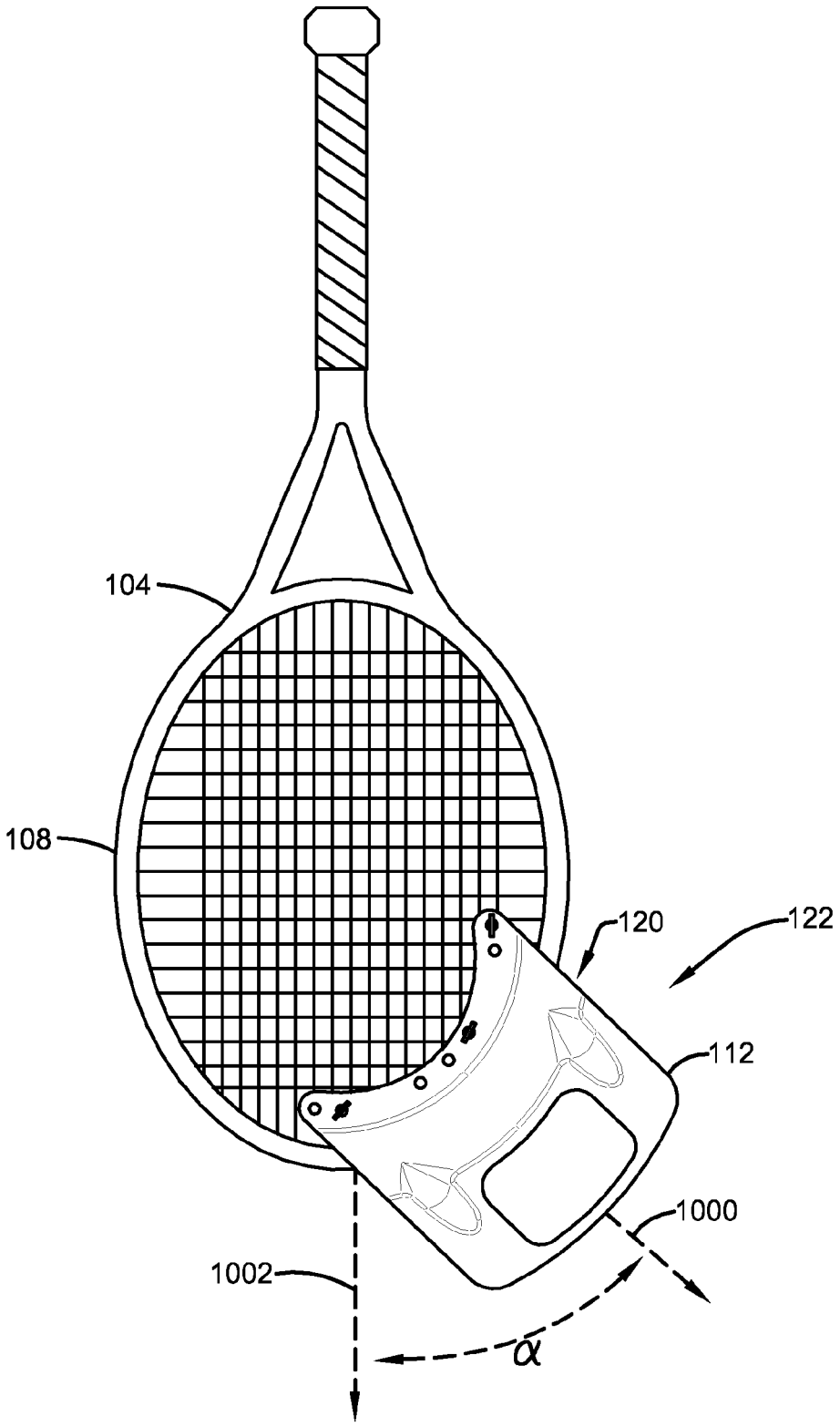

FIG. 10, shows an example of the previously described adapter 122, which has been mounted/slid to extend radially from the right side of the frame. In this example, a central radial axis 1000 of the projection 112 is orientated at a non-zero angle $\alpha$ with respect to the central longitudinal axis 1002 of the racquet 1004. In this described example the channel 120 may be sufficiently large to enable portions of the frame 108 of the racquet with a relatively wider curvature along the side/beam (compared to the tip of the frame) to extend through the channel. In this example, an angle $\alpha$ of between 20 and 70 degrees (or other non-zero angle) may allow the user to hold the racquet at a more comfortable non-vertical vertical angle when putting.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. An apparatus comprising:

an adapter adapted to removably mount to a racquet, wherein the racquet includes a frame that defines a loop, wherein the racquet includes a plurality of transversely oriented sets of strings that span the loop and are connected to the frame, wherein the racquet includes a handle connected to the frame, wherein the frame includes a tip opposite the handle, wherein the adapter includes a bottom member and a top member that are adapted to fasten to each other and form a channel therebetween, wherein the top member includes a first inner flange adjacent the channel, wherein the bottom member includes a second inner flange adjacent the channel, wherein the adapter includes a projection, wherein an exterior surface of the projection includes a substantially flat surface, wherein the top member includes an elevated portion, wherein the elevated portion includes the substantially flat surface thereon, wherein the elevated portion includes a cavity therein on an inner face of the top member, wherein the bottom member includes a further elevated portion on an inner face of the bottom member, wherein the adapter is operative to mount to the racquet such that:

a portion of the frame of the racquet extends through the channel;

the first inner flange extends adjacent a first face of the strings;

the second inner flange extends adjacent an opposed second face of the strings;

the cavity cooperatively receives the further elevated portion therein to fasten the top and bottom members together;

the projection extends radially outwardly from the frame such that the substantially flat surface of the projection is orientated parallel to the first face of the strings.

2. The apparatus according to claim 1, wherein the projection with the substantially flat surface is configured to extend radially outwardly from the tip of the frame for a distance of at least one 1 inch (2.5 cm), wherein the substantially flat surface has a width and a length of at least 1 inch (2.5 cm).

3. The apparatus according to claim 1, further comprising the racquet, wherein the first and second inner flanges include a plurality of aligned sets of holes therethrough, further comprising at least one fastener that extends through at least one set of aligned holes and which traverses the strings of the racquet.

4. The apparatus according to claim 1, wherein the projection with the substantially flat surface is configured to extend radially from the frame for a distance of at least 2 inches (5.1), wherein the substantially flat surface has a width and a length of at least 1.5 inches (3.8 cm).

5. An apparatus comprising:

an adapter adapted to removably mount to a racquet, wherein the racquet includes a frame that defines a loop, wherein the racquet includes a plurality of transversely oriented sets of strings that span the loop and are connected to the frame, wherein the racquet includes a handle connected to the frame, wherein the frame includes a tip opposite the handle, wherein the adapter includes a bottom member and a top member that are adapted to fasten to each other and form a channel therebetween, wherein the top member includes a first inner flange adjacent the channel, wherein the bottom member includes a second inner flange adjacent the channel, wherein the first and second inner flanges include holes therethrough, wherein the adapter includes a projection, wherein an exterior surface of the projection includes a substantially flat surface, wherein the adapter is operative to mount to the racquet such that:

a portion of the frame of the racquet extends through the channel;

the first inner flange extends adjacent a first face of the strings;

the second inner flange extends adjacent an opposed second face of the strings;

the projection extends radially outwardly from the frame such that the substantially flat surface of the projection is orientated parallel to the first face of the strings.

6. The apparatus according to claim 5, wherein the top member includes an elevated portion, wherein the elevated portion includes the substantially flat surface thereon, wherein the elevated portion includes a cavity therein on an inner face of the top member, wherein the bottom member includes a further elevated portion on an inner face of the bottom member, wherein the cavity is operative to cooperatively receive the further elevated portion therein to fasten the top and bottom members together.

7. The apparatus according to claim 5, wherein the projection with the substantially flat surface is configured to extend radially outwardly from the tip of the frame for a distance of at least 2 inches (5.1 cm), wherein the substantially flat surface has a width and a length of at least 1.5 inches (3.8 cm).

8. The apparatus according to claim 5, further comprising the racquet, wherein the adapter is in rigid connection with the racquet.

9. The apparatus according to claim 8, wherein the projection with the substantially flat surface extends radially from the tip of the frame in substantial alignment with a longitudinal axis of the racquet that extends through the handle, the tip of the frame, and the adapter.

10. The apparatus according to claim 8, wherein the projection with the substantially flat surface extends radially from the frame in a direction that is not aligned with a longitudinal axis of the racquet that extends through the handle and the tip of the frame.

11. The apparatus according to claim 10, wherein the projection with the substantially flat surface extends radially from the frame with an angle $\alpha$ of between 20 and 70 degrees between the longitudinal axis of the racquet and a central radial axis of the projection.

12. The apparatus according to claim 8, wherein the first and second inner flanges include a plurality of aligned sets of holes therethrough, further comprising at least one fastener that extends through at least one set of aligned holes and which traverses the strings of the racquet.

13. The apparatus according to claim 5, wherein the projection with the substantially flat surface extends radially from the frame for a distance of at least 1 inch (2.5 cm), wherein the substantially flat surface has a width and a length of at least 1 inch (2.5 cm).

* * * * *